US006266033B1

(12) United States Patent
Kim

(10) Patent No.: US 6,266,033 B1
(45) Date of Patent: Jul. 24, 2001

(54) PLASMA DISPLAY DEVICE

(75) Inventor: Dae-il Kim, Suwon (KR)

(73) Assignee: Samsung Display Device Co., Ltd., Kyungki-Do (KR)

( * ) Notice: Subject to any disclaimer, the term of this patent is extended or adjusted under 35 U.S.C. 154(b) by 0 days.

(21) Appl. No.: 09/260,057

(22) Filed: Mar. 2, 1999

(30) Foreign Application Priority Data

Mar. 4, 1998 (KR) ..... 98-7124

(51) Int. Cl.[7] ..... G09G 3/28

(52) U.S. Cl. ..... 345/66; 345/67; 313/492

(58) Field of Search ..... 325/60.72; 315/169.4; 313/492

(56) References Cited

U.S. PATENT DOCUMENTS 4,638,218 * 1/1987 Shinoda et al. ..... 315/169.4
4,737,687 * 4/1988 Shinoda et al. ..... 315/169.4
6,034,482 * 3/2000 Kanazawa et al. ..... 315/169.4

* cited by examiner

*Primary Examiner*—Steven Saras
*Assistant Examiner*—Tewolde Mengisteab
(74) *Attorney, Agent, or Firm*—Lowe Hauptman Gilman & Berner, LLP

(57) ABSTRACT

A plasma display device includes a plurality of discharge cells each having substrates, and at least two electrodes formed on the substrates, for generating a discharge therebetween, and a shielding electrode formed between the electrodes respectively positioned in the neighboring cells, for shielding crosstalk generated between the electrodes of the neighboring cells.

7 Claims, 6 Drawing Sheets

PLASMA DISPLAY DEVICE

BACKGROUND OF THE INVENTION

1. Field of the Invention

The present invention relates to a plasma display device, and more particularly, to a plasma display device with a reduced cell space by providing a crosstalk shielding electrode.

2. Description of the Related Art

In general, a plasma display device includes at least a pair of electrodes and generates discharge by a voltage applied to the electrodes. Due to excellent display characteristics such as display capacity, brightness, contrast and view angle, much attention has been paid to plasma display devices as flat display panels having almost the same performance as cathode ray tubes.

A plasma display panel is largely divided into a direct current (DC) plasma display panel and an alternating current (AC) plasma display panel according to its operational principles. In the DC plasma display panel, all electrodes are exposed to a discharge space, in which charges migrate directly from/to corresponding electrodes. On the other hand, the AC plasma display panel has a structure in which at least one electrode is surrounded by a dielectric material, wherein charges do not directly migrate from/to corresponding electrodes and discharging is performed by the electrical field of wall charges. The DC plasma display panel adopts both a DC driving method by which the polarity of a driving voltage does not change, and an AC driving method by which the polarity of a driving voltage changes. However, the AC plasma display panel adopts only the AC driving method.

Meanwhile, a plasma display panel is divided into a cross discharge type and a neighboring discharge type according to the discharge mechanism. The cross discharge type plasma display panel includes a scanning electrode opposite an address electrode, generates an addressing discharge therebetween and the addressing discharge is sustained by a sustaining discharge. The neighboring discharge type plasma display panel includes a scanning electrode and a common electrode which face an address electrode, and generates an addressing discharge between the address electrode and the common electrode and a sustaining discharge between the scanning electrode and the common electrode.

Referring to FIGS. 1 and 2, an example of a neighboring discharge type plasma display device will be described briefly. The plasma display device includes address electrodes 11 formed on a rear substrate 10 in a predetermined pattern, and a dielectric layer 12 covering the address electrodes 11 and the rear substrate 10. A partition 13 formed on the dielectric layer 12 maintains a discharge distance, and a fluorescent layer 17 is formed between neighboring partitions 13. A front substrate 16 is installed over the rear substrate 10, and a scanning electrode 14 and a common electrode 15, perpendicular to the address electrodes 11, are alternately formed on the bottom of the front substrate 16. A dielectric layer 18 is coated on the front substrate 16 and the scanning and common electrodes 14 and 15. A protective film 20 is coated on the dielectric layer 18. A predetermined discharge gas is injected to a discharge space S between the front substrate 16 and the rear substrate 10.

Referring to FIG. 2, if a voltage is applied to the respective electrodes, ions of the discharge gas accumulate on the dielectric layer 12. A trigger discharge is generated between the address electrode 11 and the common electrode 15 by the accumulated ions, and charged particles are formed on bottom surface of the dielectric layer 18 of the front substrate 16. At this time, according to image signals, a sustaining discharge is generated in the discharge space S by a predetermined voltage V applied between the scanning electrode 14 and the common electrode 15. Then, the fluorescent material is excited by the plasma formed in the discharge gas to then emit light.

Referring to FIG. 3, the electrodes 14 and 15 are repeatedly formed with a constant cell pitch CP on the front substrate 16. The cell pitch CP is a constant value as a design factor determined in consideration of resolution in a given screen size. Thus, in order to improve discharge efficiency or the brightness under a given cell pitch CP, the electrode width EW must be increased. However, since the cell pitch CP is constant, increasing the electrode width EW requires a reduction in the cell space CS. Current having pulses of opposite polarities is applied to the electrodes 14 and 15 by a circuit equivalent to one as shown in FIG. 4. In this case, if the cell space CS is small, a crosstalk discharge as well as a normal discharge is generated between the electrodes 14 and 15 positioned in the adjacent cells as shown in FIG. 5. Thus, since the reduction in the cell space CS cannot exceed a certain limit, the electrode width EW must be unavoidably reduced, which results in the reduction in the light emission area in the discharge cell to thereby decrease brightness. Also, the plasma display requires a high voltage for normal discharge. Further, since the concentration of electrical fields is lowered during discharge, which degrades the overall discharge efficiency.

SUMMARY OF THE INVENTION

To solve the above problem, it is an objective of the present invention to provide a plasma display device having a shielding electrode, by which crosstalk discharge between cells is shielded, and thus the cell space can be reduced.

Accordingly, to achieve the above objective, there is provided a plasma display device including a plurality of discharge cells each having substrates, and at least two electrodes formed on the substrates, for generating a discharge therebetween, and a shielding electrode formed between the electrodes respectively positioned in the neighboring cells, for shielding crosstalk generated between the electrodes of the neighboring cells.

The shielding electrode is electrically floated.

Also, alternatively, the substrates include front and rear substrates facing each other, the electrodes include a first electrode formed on the upper surface of the rear substrate in a predetermined pattern, and a second electrode formed on the bottom surface of the front substrate to be perpendicular to the first electrode, wherein the shielding electrode is formed between the second electrodes positioned in the neighboring cells, respectively.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
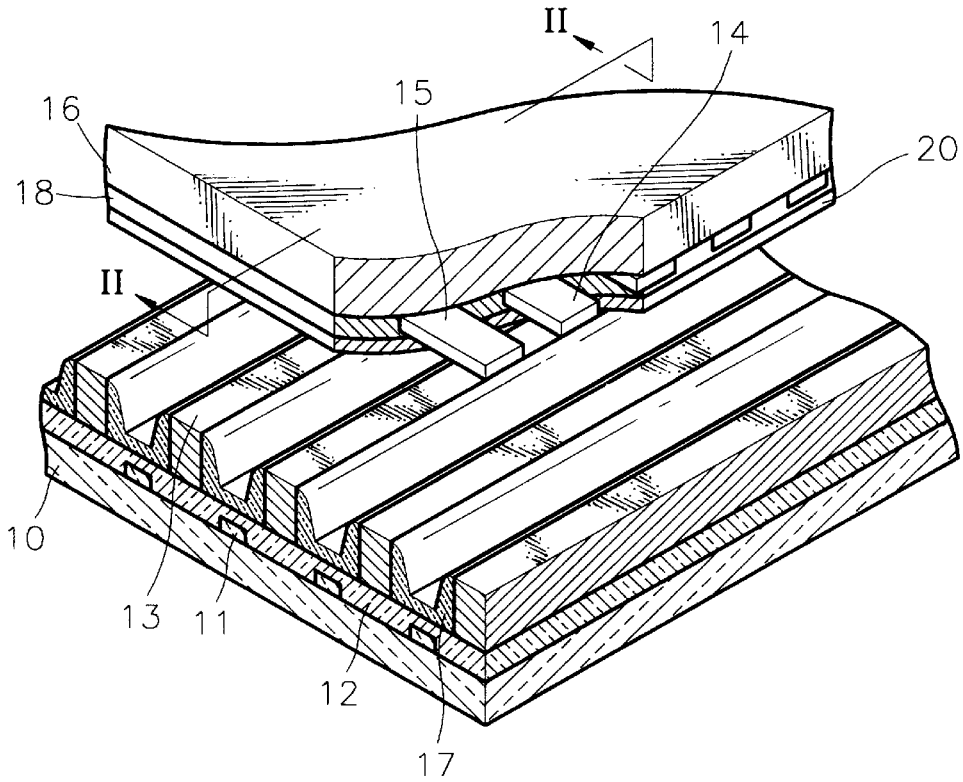
FIG. 1(PRIOR ART)
FIG. 1 is an exploded perspective view of a conventional neighboring discharge type plasma display device.
Figure 2:
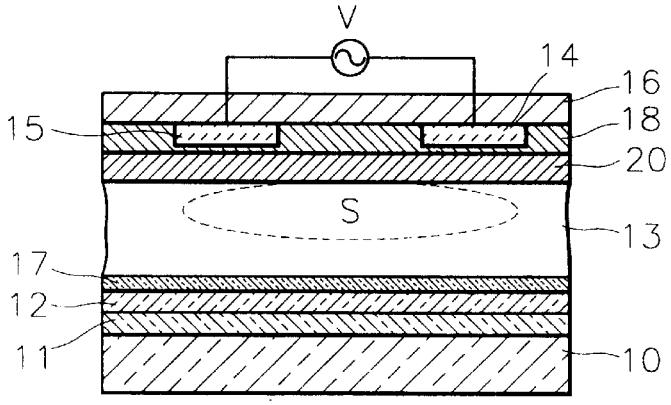
FIG. 2(PRIOR ART)
FIG. 2 is a cross-sectional view taken along line II—II of FIG. 1.
Figure 3:
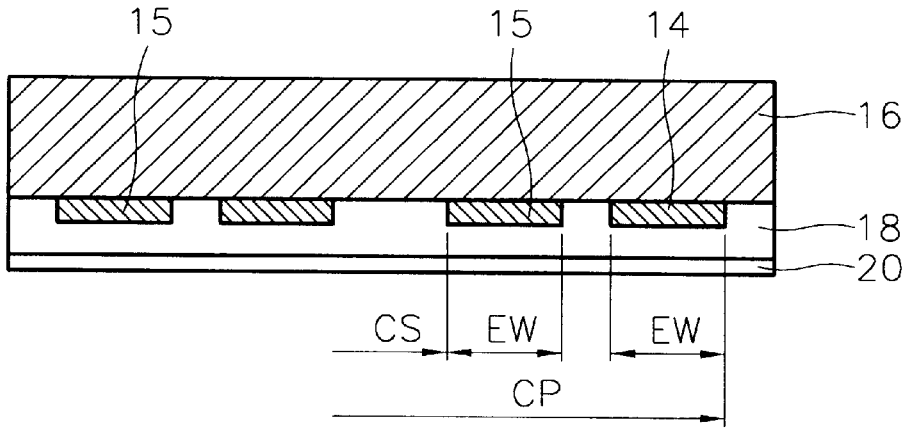
FIG. 3(PRIOR ART)
FIG. 3 is a cross-sectional view showing a portion of FIG. 2.
Figure 4:
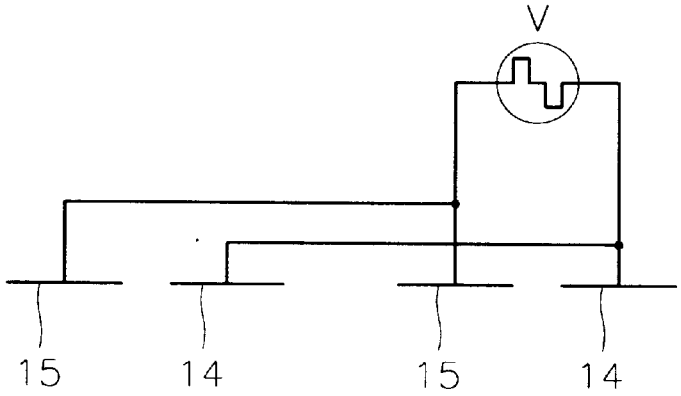
FIG. 4(PRIOR ART)
FIG. 4 is an equivalent circuit diagram, in which power is applied to electrodes shown in FIG. 3.
Figure 5:
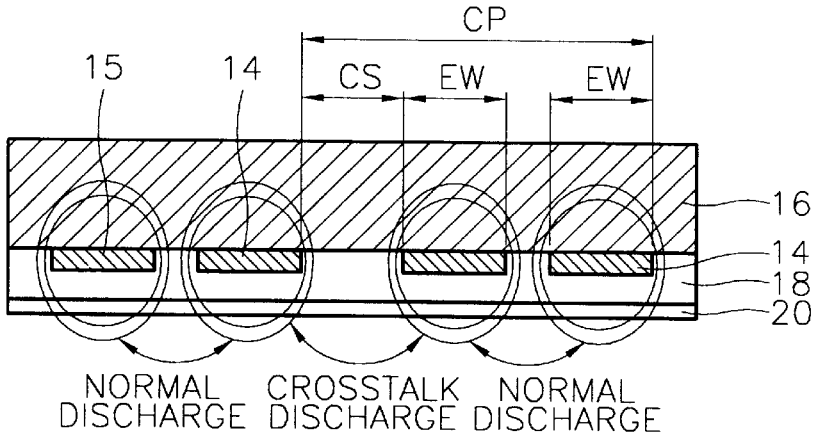
FIG. 5(PRIOR ART)
FIG. 5 illustrates an equipotential surface formed by the electrodes shown in FIG. 3.
Figure 6:
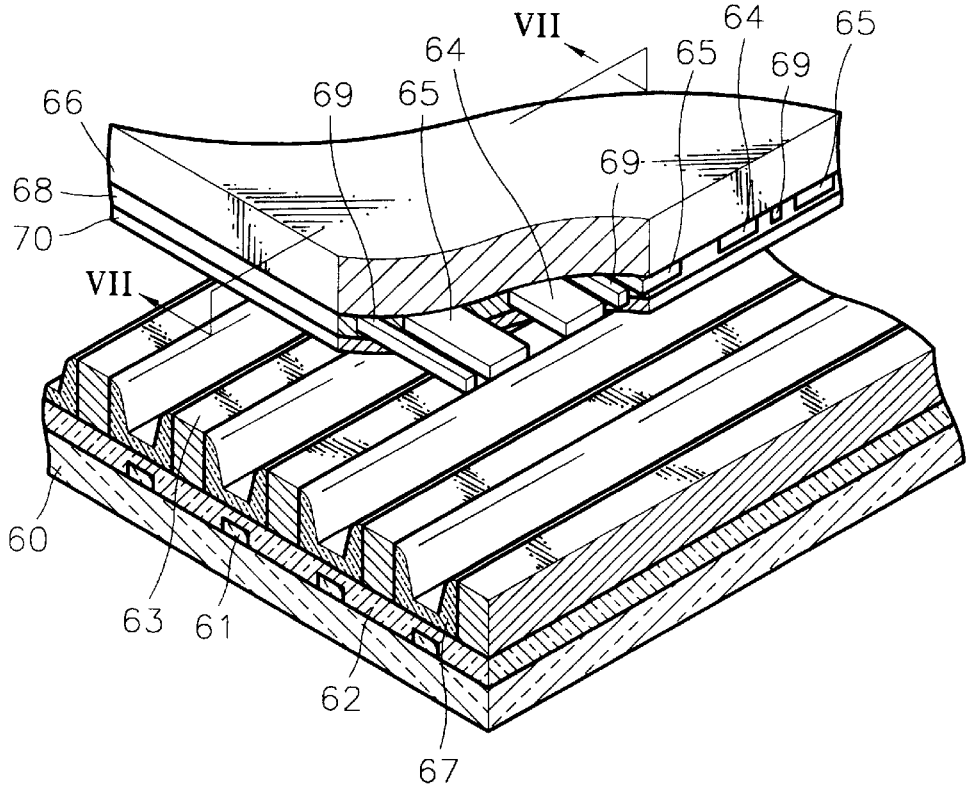
FIG. 6 is an exploded perspective view of a neighboring discharge type plasma display device according to an embodiment of the present invention.
Figure 7:
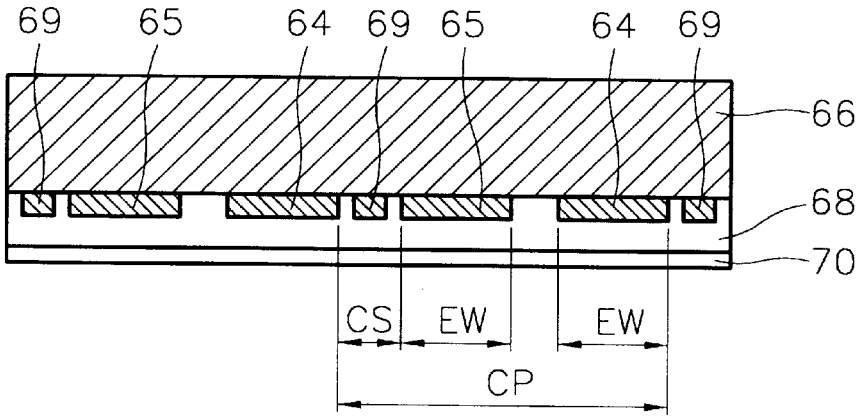
FIG. 7 is a partially cross-sectional view taken along line VII—VII of FIG. 6.

Referring to FIGS. 6 and 7 showing a neighboring discharge type plasma display device according to an embodiment of the present invention, address electrodes 61 are formed on a rear substrate 60 in a predetermined pattern, and a dielectric layer 62 covers the address electrodes 61 and the rear substrate 60. A partition 63 formed on the dielectric layer 62 maintains a discharge distance, and a fluorescent layer 67 is formed between neighboring partitions 63. A front substrate 66 is installed over the rear substrate 60, and a scanning electrode 64 and a common electrode 65, perpendicular to the address electrodes 61, are alternately installed on the bottom of the front substrate 66. The scanning electrode 64 and a common electrode 65 define an unit cell together with the neighboring partitions 63.

According to the characteristics of the present invention, a shielding electrode 69 is formed between the neighboring cells, that is, on the front substrate 66 between the scanning electrode 64 positioned in a cell and the common electrode 65 positioned in another adjacent cell.

To prevent a voltage drop, a bus electrode (not shown) may be provided in the respective electrodes 64, 65 and 69. A dielectric layer 68 is coated on the front substrate 66 and these electrodes 64, 65 and 69 formed on the bottom of the front substrate 66. A protection layer 70 made of, for example, MgO may be further coated on the dielectric layer 68. A predetermined discharge gas is injected to the discharge space between the front substrate 66 and the rear substrate 60. The discharging operation has been described above.

The shielding electrode 69 shields a crosstalk discharge occurring between the common electrode 65 of a cell and the scanning electrode 64 of another adjacent cell. Therefore, the cell space CS can be reduced, which enables the increase in the electrode width EW.

The shielding electrode 69 is made of a conductive material, preferably, an argentum (Ag) paste having a black color, for improving contrast by suppressing outer light reflection.

Figure 8:
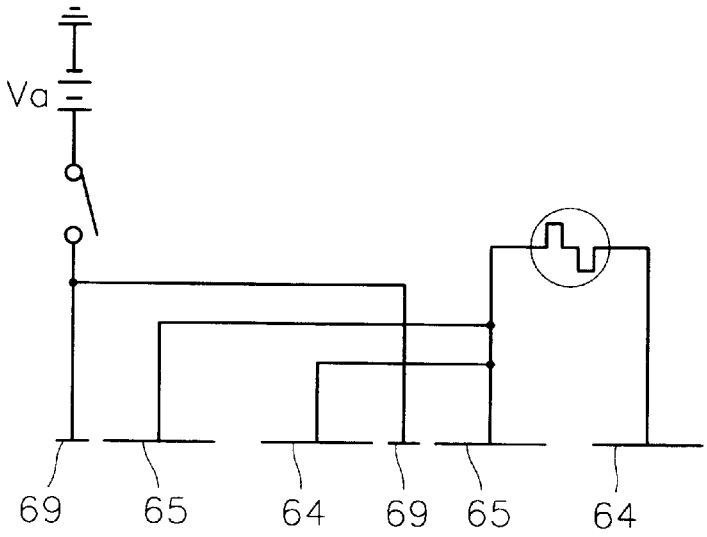
FIG. 8 is an equivalent circuit diagram, in which power is applied to electrodes shown in FIG. 7.

As shown in FIG. 8 which is an equivalent circuit diagram showing power being applied to the electrodes 64, 65 and 69, it is preferred that the shielding electrode 69 is electrically floated. Otherwise, an average DC voltage Va of voltages V applied to the electrodes 64 and 65 adjacent to the shielding electrode 69 may be applied to the shielding electrode 69.

Figure 9:
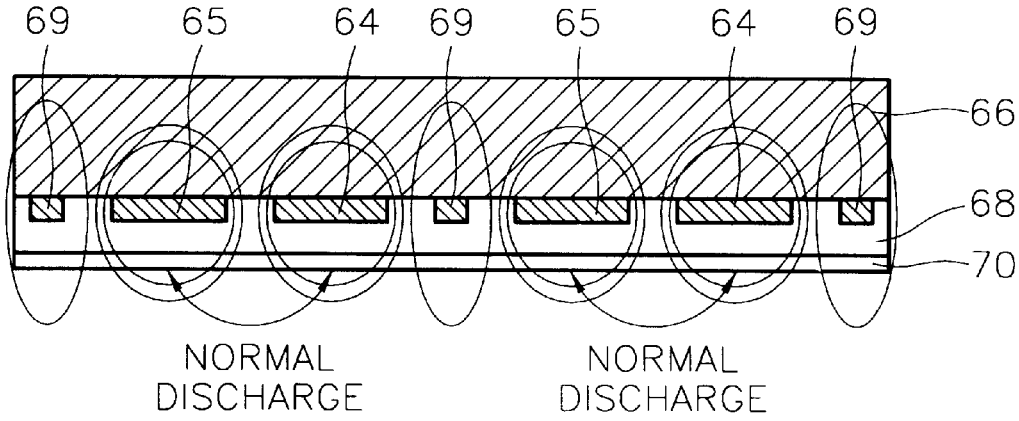
FIG. 9 illustrates an equipotential surface formed by the electrodes shown in FIG. 7.

FIG. 9 illustrates an equipotential surface formed by the respective electrodes to which power is applied. If the average voltage Va is applied to the shielding electrode 69, since a potential difference between neighboring cells is buffered by the equipotential surface formed by the average voltage of the shielding electrode, crosstalk discharge between neighboring cells is shielded. Similarly, if the shielding electrode 69 is floated, capacitive coupling of the electrodes 64 and 65 adjacent to the shielding electrode 69 affects the shielding electrode 69 as the average voltage of the electrodes 64 and 65 is applied thereto, which generates the equipotential surface preventing crosstalk discharge.

Figure 10:
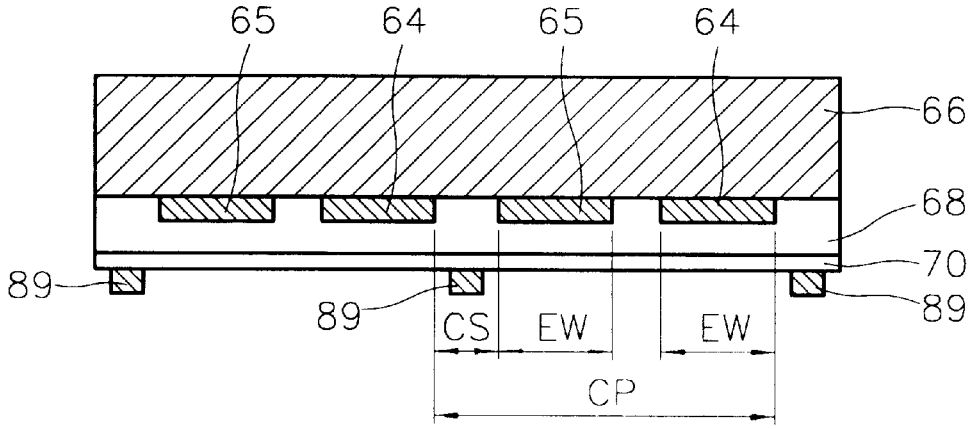
FIG. 10 is a cross-sectional view of a plasma display device according to another embodiment of the present invention.

According to FIG. 10 showing another embodiment of the present invention, a shielding electrode 89 may be formed on the dielectric layer 68 or the protection layer 70 coated on the dielectric layer 68.

Although a three-electrode sheet discharge type AC plasma display device has been described in the present invention, the present invention is not limited thereto. Also, in two-electrode/three-electrode type, neighboring/cross discharge type, and DC/AC plasma display devices, crosstalk discharge can also be suppressed by providing a shielding electrode between neighboring cells using the same principle and structure as described above.

Figure 11:
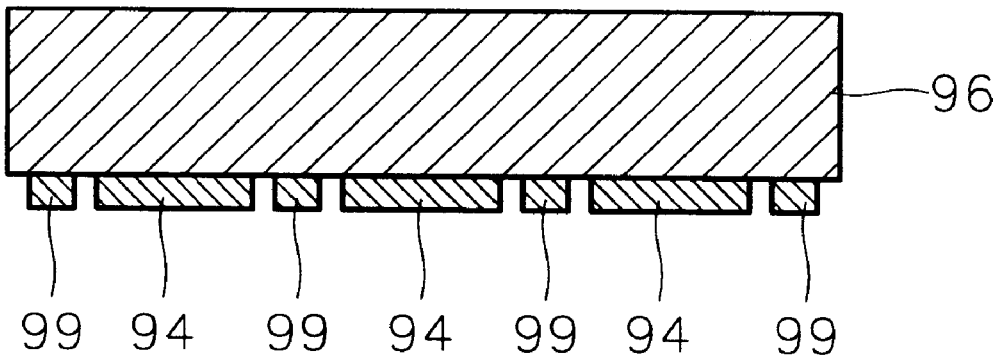
FIG. 11 is a cross-sectional view of a plasma display device according to still another embodiment of the present invention.

For example, referring to FIG. 11, a shielding electrode 99 may be formed between electrodes 94 positioned respective cells to thereby shield crosstalk between the cells. Reference numeral 96 indicates a front substrate or a rear substrate.

As described above, according to the plasma display device of the present invention, since crosstalk discharge between the neighboring cells is prevented by a shielding electrode, the cell space between neighboring cells can be reduced, and electrode width can be increased. Accordingly, the discharge area can be increased, which causes a discharge voltage applied to the electrode to decrease, thereby improving discharge efficiency. Also, since an equipotential surface is formed by the shielding electrode, the electrical field of a discharge electrode is concentrated, thus improving the discharge efficiency.

What is claimed is:

1. A plasma display device comprising:

front and rear substrates facing each other;

a plurality of discharge cells each having an address electrode formed on an upper surface of the rear substrate in a predetermined pattern, and a scanning electrode and a common electrode for generating a discharge therebetween, said scanning and common electrodes being alternately formed on a bottom surface of the front substrate to be substantially perpendicular to the address electrode; and at least a shielding electrode formed between a scanning electrode and a common electrode positioned in adjacent cells, respectively, for shielding crosstalk generated between said scanning electrode and said common electrode of said adjacent cells;

wherein the shielding electrode is electrically floated.

2. The plasma display device according to claim 1, wherein the shielding electrode is formed on the bottom surface of the front substrate.

3. The plasma display device according to claim 1, wherein an average voltage of voltages applied to the scanning electrode and the common electrode is applied to the shielding electrode.

4. The plasma display device according to claim 1, further comprising a dielectric layer coated on the bottom surface of the front substrate, wherein the shielding electrode is formed on the dielectric layer.

5. The plasma display device according to claim 1, further comprising a dielectric layer and a protection layer sequentially coated on the bottom surface of the front substrate, wherein the shielding electrode is formed on the protection layer.

6. A plasma display device, comprising:

a plurality of discharge cells each having substrates, and at least two electrodes formed on the substrates, for generating a discharge therebetween; and at least a shielding electrode formed between electrodes respectively positioned in adjacent cells, for shielding crosstalk generated between the electrodes of the adjacent cells;

wherein the shielding electrode is electrically floated; and wherein the shielding electrode is formed of a black argentum (Ag) paste.

7. A plasma display device, comprising:

a plurality of discharge cells each having substrates, and at least two electrodes formed on the substrates, for generating a discharge therebetween; and at least a shielding electrode formed between electrodes respectively positioned in adjacent cells, for shielding crosstalk generated between the electrodes of the adjacent cells;

wherein said substrates comprise front and rear substrates facing each other, and said at least two electrodes comprise a first electrode formed on an upper surface of the rear substrate in a predetermined pattern and a second electrode formed on a bottom surface of the front substrate to be substantially perpendicular to the first electrode, wherein the shielding electrode is formed between the second electrodes respectively positioned in the adjacent cells; and wherein the shielding electrode is formed of a black argentum (Ag) paste.

* * * * *